US006136043A

United States Patent [19]

Robinson et al.

[11] Patent Number: 6,136,043

[45] Date of Patent: Oct. 24, 2000

[54] POLISHING PAD METHODS OF MANUFACTURE AND USE

[75] Inventors: Karl M. Robinson; Michael A. Walker; John K. Skrovan, all of Boise, Id.

[73] Assignee: Micron Technology, Inc., Boise, Id.

[21] Appl. No.: 09/294,908

[22] Filed: Apr. 20, 1999

Related U.S. Application Data

[60] Division of application No. 08/832,979, Apr. 4, 1997, which is a continuation-in-part of application No. 08/653,239, May 24, 1996, Pat. No. 5,733,176.

[51] Int. Cl.[7] ..... D06P 5/00; D06P 3/24; D06P 3/80; D06P 3/87; B24B 1/00

[52] U.S. Cl. ..... 8/485; 8/494; 8/506; 8/515; 8/522; 8/478; 216/84; 216/89; 451/8

[58] Field of Search ..... 8/485, 494, 506, 8/515, 522, 478; 216/84, 89; 451/8

[56] References Cited

U.S. PATENT DOCUMENTS

| | | | |
|---|---|---|---|
| 4,019,289 | 4/1977 | Korver | 451/921 |
| 5,144,773 | 9/1992 | Flores et al. | 451/8 |
| 5,439,551 | 8/1995 | Meikle et al. | 156/626.1 |
| 5,483,568 | 1/1996 | Yano et al. | 451/8 |
| 5,733,176 | 3/1998 | Robinson et al. | 451/41 |
| 5,736,427 | 4/1998 | Henderson | 428/14 |
| 5,913,713 | 6/1999 | Cheek et al. . | |

FOREIGN PATENT DOCUMENTS

| | | | |
|---|---|---|---|
| 363312072 | 12/1988 | Japan | 451/21 |
| 403281168 | 12/1991 | Japan | 451/21 |

*Primary Examiner*—Margaret Einsmann
*Attorney, Agent, or Firm*—Workman, Nydegger & Seeley

[57] ABSTRACT

The present invention is directed to polishing pads useful in determining an end to the useful wear life thereof. In a simple embodiment of the present invention, a polishing pad that is used with slurries is dyed on one side in a manner that causes the dye to permeate the pad to a limited depth that does not cause total coloring. Another embodiment of the present invention involves a fixed abrasive pad that has fixed abrasives embedded into the pad to a selected depth where at least one color level is within the portion of the pad that contains the fixed abrasives. After dyeing the pad, the pad is attached to the polishing platen. During the polishing operation, a color change signals a time to stop the polishing operation and change the pad. With multiple colors in the pad, limited only by the ability to dye the pad with uniform depth levels, characteristic wear patterns can be observed and adjustments made accordingly to prolong and optimize pad life. A pad having voids and optional abrasives incorporated therein is also disclosed. The contents of each void facilitates the detection of the degree to which the polishing pad has been worn during a polishing operation. Substances may be stored within voids that are released by the breach of the voids caused abrasion during the polishing operation. Visual or audible diagnostics resulting from the breaching of voids are useful to control the polishing operation and thus increase yield.

29 Claims, 6 Drawing Sheets

POLISHING PAD METHODS OF MANUFACTURE AND USE

RELATED APPLICATIONS

This is a divisional U.S. patent application Ser. No. 08/832,979, filed on Apr. 4, 1997, titled "POLISHING PAD, METHODS OF MANUFACTURE AND USE", which is a Continuation-In-Part of U.S. patent application Ser. No. 08/653.239 entitled "Polishing pad and method of use" filed on May 24, 1996, now U.S. Pat. No. 5,733,176, both of which are incorporated into the present invention by specific reference.

BACKGROUND OF THE INVENTION

1. The Field of the Invention

The present invention relates generally to polishing of surfaces such as glasses, semiconductors, and integrated circuits. More particularly, this invention relates to polishing pads that provide wear analysis during polishing and an indication as to the end of the useful life thereof. A method of using the pad is also disclosed. The method of using detects the "worn out" status of the pad, either by automation or such that an operator of a polishing machine, such as a chemical mechanical polishing machine, for semiconductor devices will see, hear, or otherwise detect the point at which a polishing pad has reached the end of its useful life.

2. The Relevant Technology

In the microelectronics industry, a substrate refers to one or more semiconductor layers or structures which includes active or operable portions of semiconductor devices. In the context of this document, the term "semiconductor substrate" is defined to mean any construction comprising semiconductive material, including but not limited to bulk semiconductive material such as a semiconductive wafer, either alone or in assemblies comprising other materials thereon, and semiconductive material layers, either alone or in assemblies comprising other materials. The term "substrate" refers to any supporting structure including but not limited to the semiconductor substrates described above.

Polishing solutions, polishing pads, and slurries are used in chemical-mechanical planarizing (CMP). With slurries, a part or substrate to be polished is bathed or rinsed in the slurry in conjunction with an elastomeric pad which is pressed against the substrate and rotated such that the slurry particles are pressed against the substrate under load. In a fixed-abrasive pad, an abrasive is contained within the pad itself, and the substrate can be polished in either a wet or a dry application. The technique can be accomplished by mechanical planarization (MP) or by CMP.

The polishing mechanism is a combination of mechanical action and the chemical reaction of the material being polished with the solution. The chemical action oxidizes or otherwise treats the most superficial layer, and the mechanic action shears away the treated material. The lateral motion of the pad causes the abrasive particles to move across the surface of the substrate, resulting in pad wear and volumetric removal of the surface. CMP can involve alternative holding and rotating of a substrate against a wet or dry polishing platen under controlled chemical, pressure and temperature conditions. Typically, CMP uses an aqueous colloidal silica solution as the abrasive fluid. Alternatively, the pad itself will contain all the abrasive embedded within its wear surface.

In the semiconductor industry, CMP is used for a variety of surface planarizations. There are various types of planarizable surfaces on a semiconductor substrate, including conductive and insulating materials, such as oxides, nitrides, polysilicon, monocrystalline silicon, amorphous silicon, and mixtures thereof. The substrate has thereon conductive or non-conductive material or both, and the substrate is generally a semiconductor material, such as silicon.

As circuit densities increase, CMP has become one of the most viable techniques for planarization, particularly to planarize interlevel dielectric layers. In view of this increasing viability, improved methods of CMP are increasingly being sought.

A CMP pad is made by one of several methods. One method is to extrude pad material through a large die, the diameter of which is the diameter of a finished polishing pad. After extrusion, the pad is sliced from the extruded stock. Care is taken to make the slice with uniform thickness across the entire pad. Another method is to make a continuous web, roll, or tape of polishing pad material that is taken up onto a spool. During CMP or MP the pad is incrementally advanced by the operator when it is determined that the pad is worn.

One aspect of CMP in need of improvement is worn-pad detection of the useful life of the polishing pad. This detected point occurs before the pad has worn completely through and must be discovered before the article being polished is irreparably damaged by the underlying polishing platen. Although optimizing speed and throughput of the process for semiconductor manufacture are economic imperatives, avoiding damage to any given substrate that happens to be in the polisher at the time the useful life of the pad has expired is also a desired result.

In general, CMP is a relatively slow and time-consuming process. During the polishing process, semiconductor devices must be individually loaded into a carrier, polished, and then unloaded from the carrier. The polishing step in particular is time consuming and may require several minutes. In past practice, the operator would be required to keep an accounting of the number of device polishings for a given pad and then, based upon past experience, discard or increment the pad before it had completely worn out and damaged the substrate or substrates being polished.

Because semiconductor polishing is in a constant state of flux, different techniques have been developed in the art for increasing the speed and throughput of the CMP process. As an example, more aggressive aqueous solutions have been developed to increase the speed of the polishing step. lighter carrier downforces, pulsed downforces, and higher RPMs for the polishing platen are also used.

Although current polishing techniques are somewhat successful, they may adversely affect the polishing process and the uniformity of the polished surface. Worn-pad detection, for instance, is more difficult to estimate when aggressive solutions and higher carrier downforces are employed. In addition, the polishing process may not proceed uniformly across the surface of the article to be polished. The hardness or composition of an article to be polished or the polishing platen may vary in certain areas. This in turn may cause an article to polish faster or slower in some areas, affecting its global planarity. This problem may be compounded by aggressive solutions, higher carrier downforces, and increased RPMs.

The constant change in semiconductor processing technology and the ever-increasing complexity of substrates and polishing techniques, makes prior art methods more difficult for the operator to estimate when a pad is sufficiently worn. Pad replacement techniques based only upon past experience can result in underuse of the pad or in overuse. Pad underuse wastes valuable pad life and operator time, and pad overuse results in a damaged or destroyed batch of articles being polished.

Another problem that arises in CMP technology is when an irregular pad slice is cut from extruded stock but is undetectable to the naked eye. A routine measurement around the perimeter of a slice with a micrometer will show if the slice has thicker or thinner regions than other regions.

Alternatively, the operator could spend significant time conditioning an irregularly cut pad in order to attempt to obtain a virtually flat pad. Conditioning by prior art methods requires extra time and also requires estimating, because removing the pad from the platen may be destructive to the pad.

Another problem in the prior art is where a polishing platen itself contains a planarity defect such that a high or low spot would cause the pad to prematurely wear through at the defect. In the case of a high spot, the remaining pad has to be wasted because the pad would have to be removed before the article to be polished was destroyed.

Another problem that occurs is irregular wear patterns. These patterns become a weak spot on the polishing pad and become more and more enhanced until a hole wears through the pad before the entire pad surface can be uniformly utilized.

In view of these and other problems of prior art polishing and planarizing processes, there is a need in the art for improved methods of worn-pad detection in polishing operations that is accomplished by improved pad construction.

SUMMARY OF THE INVENTION

The present invention is directed to a CMP pad that assists the operator in determining when it is at the end of its useful wear life. In particular the present invention is directed to methods of making and using a CMP pad, Methods are disclosed of making pads that include pad coloring schemes that impart topographical coloration to the pad and that allow the operator to determine pad wear patterns as well as self-limiting features in the pad that stop chemical and/or mechanical aspects of planarizing operations, such as CMP.

In a simple embodiment of the present invention, a polishing pad made from selected material is dyed on one side in a manner that causes the dye to permeate the pad to a limited depth that does not cause total dyeing of the pad. After dyeing the pad, it is attached to the polishing platen. Polishing begins and slurries are added to the polishing operation. When a color change is noticed, an operator stops the polishing operation and changes the pad. When the pad is dyed only superficially, the dyed side is placed against the platen and the color change from original pad color to the dyed color indicates the end of the useful life of the pad, or where an operator should change the pad so as to avoid an undesireable result from further use of the pad.

In another embodiment of the present invention the pad has fixed abrasives and the dye is applied into the fixed abrasive side, usually the top side of the pad, such that when the abrasives are worn away the dyed portion has also worn through to the undyed portion. Alternatively, the abrasive particles can have a visibly distinguishable color which can be detected during the polishing operation.

Another embodiment of the present invention involves a fixed abrasive pad that has fixed abrasives embedded into the pad to a selected depth and at least two differently dyed levels are within the pad portion that contains the fixed abrasives. As pad wear progresses, a three-dimensional map of the pad forms such that wear depth lines are highlighted by colored topographical lines on the pad if wear between levels is uneven.

In another embodiment, the present invention provides improved methods of CMP that are suitable for large scale semiconductor manufacture and in which increased process speeds and throughput are obtained without requiring undue vigilance over the CMP pad's reaching a worn-out stage undetected, thus increasing throughput and yield. Another embodiment of the present invention provides for automated worn-pad detection that monitors the degree of CMP that has occurred on the substrate under polishing such that the substrate can be properly finished with the new pad without requiring the operator to estimate the proper remaining time for CMP of the substrate with a new polishing pad.

A further embodiment of this invention is a self-limiting pad structure that automatically indicates when it is at the end of its useful life and before the polishing platen has damaged the substrate.

A further embodiment of this invention is to provide for an apparatus that is suited for automated worn-pad detection, an algorithm for worn-pad detection, and for properly finishing a current polishing job with a new pad.

A chemical can be stored within one or more of the voids which, when breached by the wearing of the fixed abrasive pad, releases the chemical therein to the polishing environment. The chemical released from the breached void can be selected to effect a change in the chemical environment of the polishing operation, such as a change that would halt the chemical polishing upon the polished substrate. Alternatively, the chemical released from the breached void can be selected to effect a change in color of the fixed abrasive pad itself. As a further alternative, a friction-reducing lubricant can be stored in the one or more voids. There will be a detectable change in the torque load on the rotating fixed abrasive pad when the lubricant is released from one or more breached voids in the fixed abrasive pad.

Where the one or more voids within the fixed abrasive pad is empty, an audible "chirping" sound from the fixed abrasive pad is produced by fluids such as air that are forced into the one or more voids by the polishing operation, similar to operational principles of a whistle.

The positioning and placement of the one or more voids can be optimized to facilitate a calculation as to the remaining useable life of the fixed abrasive pad. As such, the visual and/or audible diagnostic resulting from the breach of the one or more voids serve to notify an operator of a polishing machine when to remove the fixed abrasive pad from the polishing surface. The proper time to remove a worn-pad detected pad is based upon a calculable remaining time that the fixed abrasive pad is capable of polishing the surface so as to yield a uniform polishing of a polished surface.

Because polishing pads are usually of a pale color, a dyeing scheme may be employed that has a darkest pad color at a first surface of the pad, and a color progression to a lightest color and then the pale, undyed pad at a second surface of the pad. This scheme allows the operator to notice visible indicia if the pad begins polishing with the pale, undyed surface as the first polishing surface, where the darkest color shows when the pad is worn to the lowest color level. The polishing pad may be installed with the undyed, pale portion against the polishing platen if the polishing platen is a dark color. With multiple colors in the pad, limited only by the ability to dye the pad with relatively uniform spatial levels, the operator can observe characteristic topographical wear patterns in the pad and can make adjustments accordingly to prolong and optimize pad life.

The dyeing scheme can also be accomplished in which the original pale color is in the middle of the pad, and dyes are applied to both the first and the second sides of the pad. In this scheme, the same color can be applied to both sides in a manner that permeation of the dye stops before the mid point has been reached. Thus, during pad usage, the operator observes, for example, a red-pale-red pad wear progression.

When an irregular slice of polishing pad is fabricated, it is often the case that the irregular slice is undetectable to the naked eye but can be measured with a micrometer. The dyeing method of the present invention prepares a pad with both uniform thickness and uniform dye levels, even when the pad was originally irregularly fabricated. The method comprises dyeing one surface with at least one dye and attaching that surface to the polishing platen. Because the polishing platen is virtually flat, the at least one dyed level lies also virtually flat upon the platen. Conditioning is then carried out until the deepest-penetrating dyed level is uniformly exposed to the operator. In this way the operator knows that a virtually planar polishing pad upper surface has been achieved, and the operator can perform polishing in a way that allows for use of the entire pad surface uniformly.

With a virtually planar pad upper surface, the operator can also adjust the article to be polished to areas on the pad that indicate less wear during the useful service life of the pad as dyed. In an alternative method, an irregularly fabricated pad is dyed on either side thereof that is to be attached to the platen or that is to be the working face. As polishing progresses, the operator observes wear patterns and moves articles being polished to pad areas that are wearing more slowly than other areas.

These and other features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The present invention is directed to methods of polishing pad making, polishing pad usage, and to polishing pad articles of manufacture that overcome intermediate and worn-pad wear problems of the prior art. The inventive methods are directed to rotational oscillatory, and linear polishing operations, and combinations thereof. The present invention teaches forming a polishing pad precursor material into a polishing pad having a substantially planar shape. The polishing pad precursor material is preferably at least one material selected from the group consisting of polyurethane, polyvinyl, polymethylmethacrylate, polytetrafluoroethylene, natural resins, synthetic resins, and derivatives thereof.

The polishing pad that is used with slurries is dyed on one side in a manner that causes the dye to permeate the pad to a limited depth. This may not cause total dyeing of the pad. After dyeing the pad, it is attached to the polishing platen. Polishing begins, and when color change is noticed, the operator either modifies the polishing operation to maximize pad usage or stops the polishing operation and changes the pad.

Figure 1:
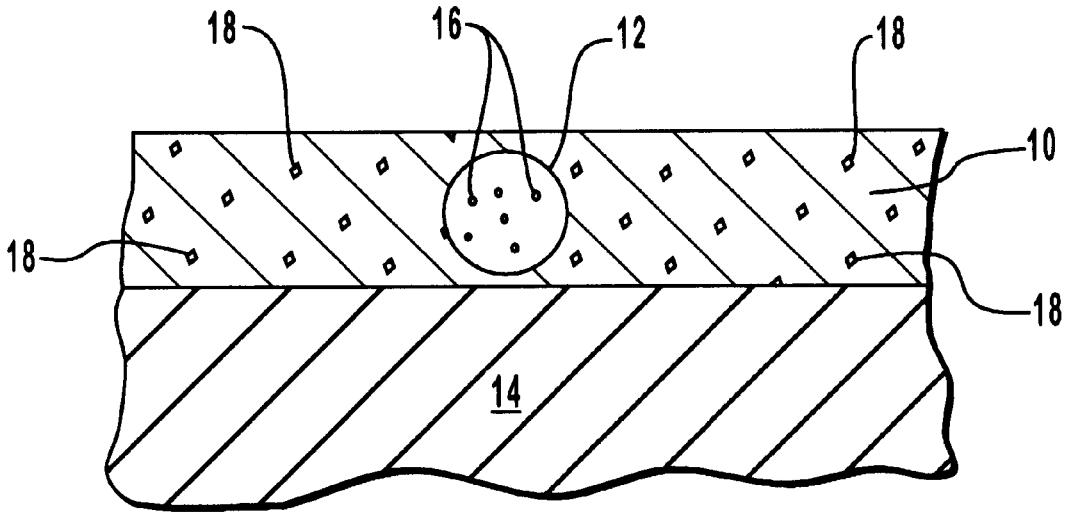
FIG. 1 shows a partial cross-sectional view of an embodiment of a new and unused fixed abrasive pad having an unbreached void incorporated therein.

FIG. 1 shows a partial cross-sectional view of an embodiment of a new and unused polishing pad 10 having therein an unbreached void 12 containing an indicator substance 16. Pad 10, which is situated upon a web 14, has many particles of a first abrasive 18 incorporated therein. While void 12 is depicted in cross-section as circular, other shapes are contemplated.

Figure 2:
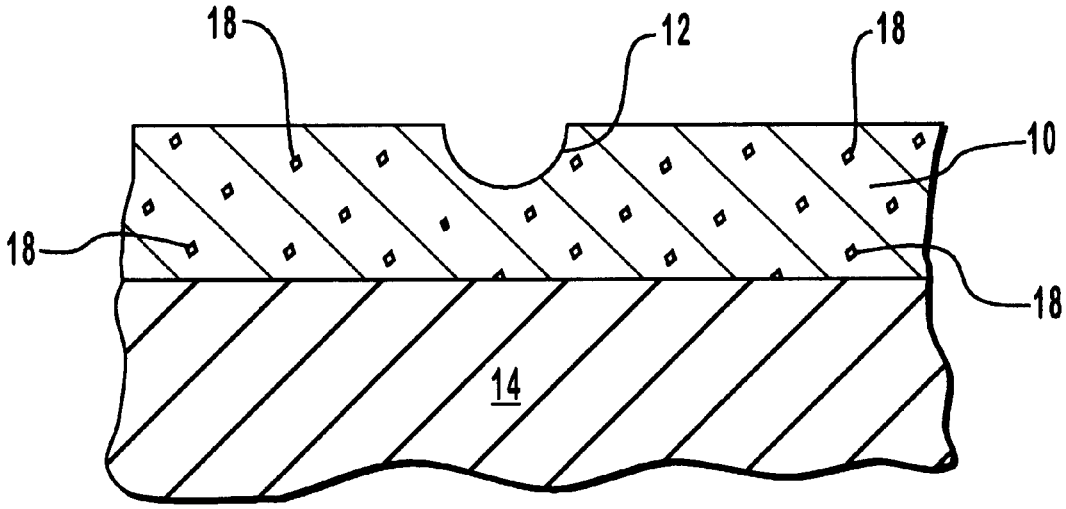
FIG. 2 shows a partial cross-sectional view of the fixed abrasive pad of FIG. 1, where the void has been breached due to wearing down of the fixed abrasive pad so as to release the contents thereof.

FIG. 2 shows a partial cross-sectional view of pad 10 after being worn down in a polishing operation so as to breach void 12 and release therefrom indicator substance 16.

Figure 3:
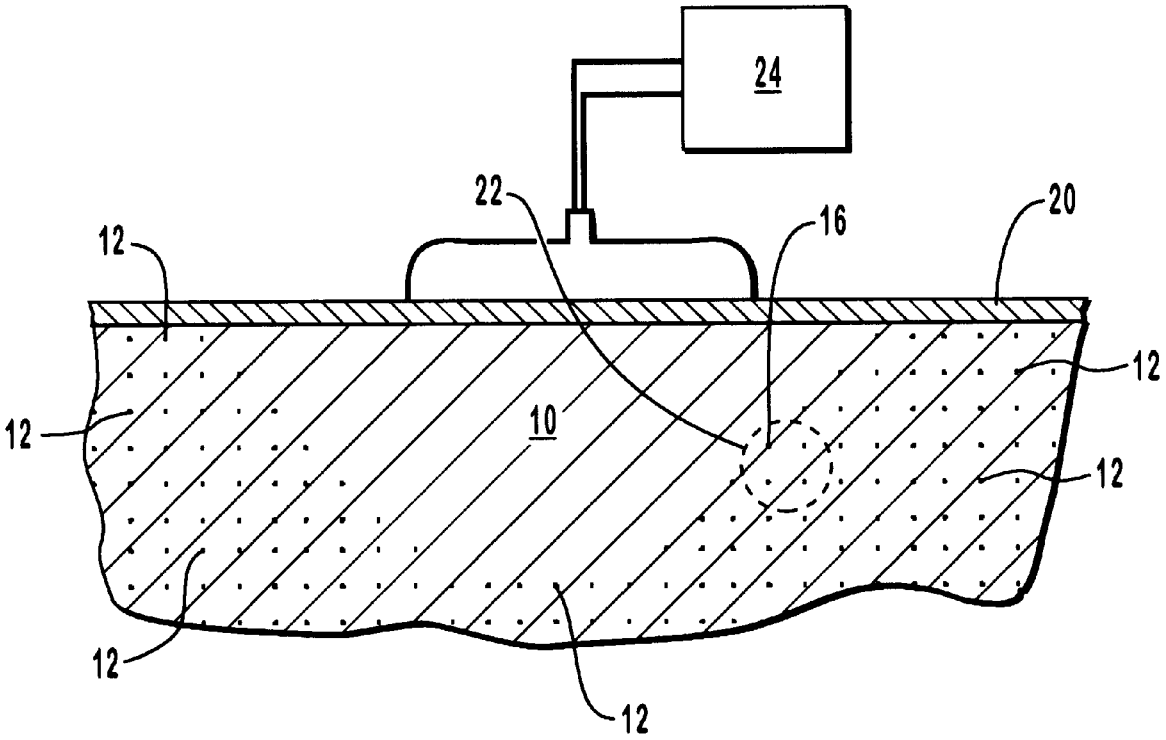
FIG. 3 is a partial cross-sectional view of a preferred embodiment of the fixed abrasive pad incorporating therein a plurality of voids, the fixed abrasive pad being used to polish a substrate, such as a semiconductor substrate, in a CMP processing step.
Figure 4:
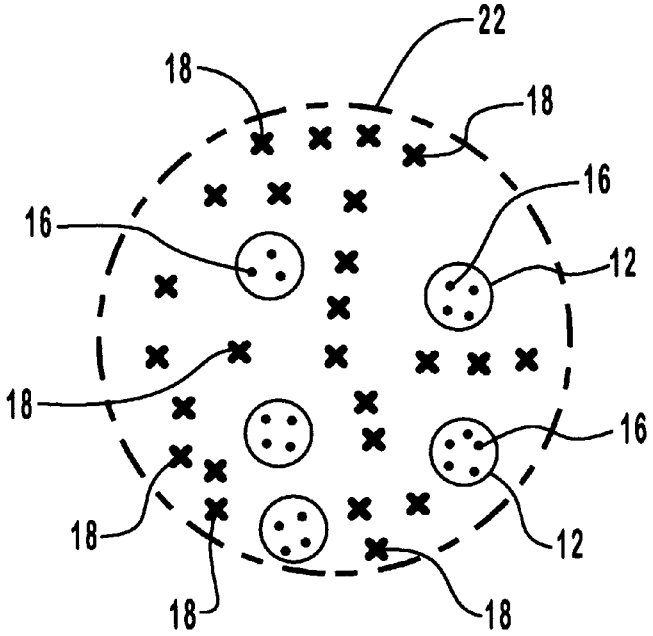
FIG. 4 is an enlarged partial cross-sectional view of the fixed abrasive pad seen in FIG. 3.

A substrate 20 is seen in FIG. 3 as being polished in a CMP polishing operation by pad 10 having therein a plurality of voids 12 each containing worn-pad indicator substance 16. Substrate 20 can be a glass surface, a semiconductor surface, a dielectric surface, or a semiconductor substrate. An enlarged view of a cut away cross-section 22 in FIG. 3 is seen in FIG. 4, where several particles of first abrasive 18 are shown as placed around and about voids 12.

In a CMP operation, a device for moving at least one of the polishing pad and the semiconductor substrate relative to and in contact with the other is used. By way of example and illustrative of such a device, FIG. 3 shows that substrate 20 is held by a chuck and rotation arm 24 so as to rotate relative to and in contact with pad 10. Of course, other and conventional means are also contemplated for this function.

Fluid in the ambient can occupy space between substrate 20 and pad 10. Air is positively introduced by pressure differentials therebetween, and a polishing liquid such as a slurry used in a typical CMP operation can also be positively introduced similarly.

1. Abrasives

Typically, fixed abrasives, can be silica or ceria, thoria, or zirconia particles. An example of such abrasives is seen in FIGS. 1, 2, and 4 as particles of first abrasive 18. Recent improvements in the abrasives art include polishing compound accelerants that are either co-precipitated with the abrasive or which are contained in the washing solution, both of which expedite polishing either by enhanced or chemical means or both.

2. Fixed-Abrasive Polishing Pads

Fixed-abrasive pads of the present invention are preferably in a range of about 10 to about 100 mils thick. The pads are molded from composite or elastomeric substances and the abrasives can be fixed either before or after the molding process. The fixed abrasives can be laid out within the fixed abrasive pad in a variety of preferred configurations, including squares, 'X' patterns, star patterns, or scattered randomly so as to appear homogeneously from a macroscopic view. Grooves or voids, an example of which is seen in the Figures as voids 12, may contain worn-pad indicator substances. Each void may contain a worn-pad indicator substance such as a chemical indicator, a physical indicator such as air only, or an optical indicator such as a die. Voids containing differing worn-pad indicator substances can be combined into a fixed abrasive pad so as to provide a variety of chemical, physical, or optical diagnostics indicative of the wearing of the fixed abrasive pad and the end of the useful life of the fixed abrasive pad.

Physical worn-pad indicators include grooves or voids either or both of which can be laid out in patterns similar to the fixed abrasive patterns underlying the fixed abrasives. The voids are also provided in the underlying layer in concentric circles or in a completely random manner that appears to be macroscopically homogeneous. FIG. 3 illustrates a preferred arrangement of voids 12 which facilitates a progressively increasing number of breached voids as the thickness of pad 20 is reduced during the polishing of substrate 10.

The voids containing the worn-pad indicator substance range in size depending upon the type and nature of the polishing operation. The voids can be formed by such techniques as macroscopic photolithography. In one fabrication example, pads are formed by a lay-up technique. In the lay-up technique, a pad is fabricated by doctor blading and curing a first pad precursor layer onto a palate, applying a thin second pad precursor layer of a precursor material upon the first pad precursor layer, and exposing the second pad precursor layer to photolithographic processes that cause optionally patterned depressions to form in the precursor material of the second pad precursor layer. The next step is to fill the depressions with an indicator substance, if desired, and to cover the depressions with a third precursor material. The method of laying up is then completed by curing the entire lay-up such that each layer substantially melds with each contiguous layer to form a substantially continuous, cohesive pad. The lay-up technique can be repeated as many times as is desired to achieve a preferred composite pad for a specific application.

Other techniques for pad fabrication include dispersing an insoluble indicator substance into a pad precursor material in such a manner that the indicator is fixed into the pad material in discrete portions. The insoluble indicator substance can be air, a lubricant, a pH indicator, a metal contaminant, and the like. After dispersion, the pad precursor material is extruded or cast.

When the fixed abrasive pad has substantially worn away, the underlying grooves or voids are exposed and a variety of means for detection are used. First, if the grooves or voids are empty, an audible squeaking or "chirping" of the worn pad will occur. The groove or void size will dictate the chirping pitch as fluids such as air are forced into and out of the groove or void during polishing. Detection is purely auditory by a polishing machine operator. Alternatively, a sound detector with a feed back loop controller can be incorporated with the polishing machine.

The grooves or voids can become exposed or ruptured all at the same time by fabricating the pad with the grooves or voids in a coplanar arrangement. This arrangement would create a virtually global, simultaneous, or catastrophic rupturing if desired. Alternatively, the grooves or voids can be vertically staggered so that their rupture is gradual. The stagger is designed to be uniform or non-uniform depending upon the preferred method of worn-pad detection. A preferred nonuniform staggered arrangement of the grooves or voids is a reversed elution curve profile frequency of occurrence as the pad progressively abrades. Ultra-sensitive detection will notify the operator upon the rupturing of the first few voids, if desired. Less sensitive detection means will notify the operator upon rupture of the bulk of the voids.

Other physical indicators can be used to monitor the end of the useful life of the pad. such as the torque load on the rotating platen or the strain on a holder arm for a belt pad. The physical indicator can be a detectable signal in the form of a change in a coefficient of friction between the polishing pad that is in contact with the surface being polished. When a lubricant is released from ruptured or breached voids, a change in the coefficient of friction between the polishing pad that is in contact with the surface being polished occurs, which occurrence can then be detected.

When a new fixed abrasive pad is put into service, a polishing machine operator or a digital computer operating the polishing machine can acknowledge the torque load and a control feedback loop then uses a time-smoothed steady-state torque load of the new fixed abrasive pad as the set point. Tuning a control loop with a preferred reset rate will depend upon that application and is job specific. When the torque load changes materially because the fixed abrasive pad is worn and the apparatus is trying to maintain the set point with a physically changed pad, the operator or the computer then determines whether the fixed abrasive pad is at the end of its wear life. When CMP uses pulsed polishing pressure, the torque-load detection method would require monitoring of a sinusoidal torque wave that is difficult and impractical to interpret. Thus, with pulsed polishing, chemical, optical, or audio detection methods are preferred.

In torque-load indicator applications, the grooves or voids can contain substances or can be empty. If the grooves or voids have a lubricating substance, release of the substance will cause a sudden or gradual lessening of the torque load as mentioned above. A lubricating substance that is inert to the polishing surface is preferred because the surface will not be abraded before the operator or computer has been notified that the pad is worn beyond the useful life thereof.

An alternative physical indicator is a simple current meter that monitors the current draw to rotate the polishing platen, or to advance the belt pad. When the lubricant in breached voids is released, a change in the torque required to maintain the predetermined load will occur. The operator or a digital computer monitors the current draw and a signal alerts the operator or the digital computer to determine if the change in current draw is due to a worn pad.

Chemical worn-pad indicators are released if the grooves or voids contain chemical indicator substances, to indicate the end of the useful life, or even to stop the chemical activity of the CMP process. Chemical indicators may include buffering agents that halt the chemical activity of the CMP process. Buffering agents are preferably of pH below neutrality because chemical agents in CMP are used in the range of pH 8–11, preferably 9–10. The preferred pH of the buffer solution is in the range of pH 1–6, more preferably pH 2–5 and most preferably pH 3–4.

Other chemical indicators are dissolved salts or other solutions, which are inert to the chemical makeup of the polishing surface, that have a predetermined electrical conductivity. As the indicator solutions are washed from the pad and the surface of the substrate, the draining solution passes through a tube and a pH or electrical potential is measured across the solution in the tube. As the pH or conductivity of the solution changes upon release of the indicator in the grooves or voids, an operator or an automated monitoring means stops the CMP apparatus and a new fixed abrasive pad is used to replace the worn pad.

Another indicator solution contemplated is a compound that has an exothermic reaction when exposed to ambient fluids such as the slurry in a CMP process or air around the fixed abrasive pad. The detection of a degree of temperature change indicates a degree of pad wear.

Alternative chemical indicators contemplated are cleaning solutions that assist in removing dislodged abrasives from the surface of the substrate. Because a surface on a semiconductor substrate must be cleaned after CMP and before a next processing step, the chemical worn-pad indicator in the one or more of the voids is selected to begin the cleaning process. Each CMP step in semiconductor processing introduces metal contaminants onto the surface of the substrate. A cleaning solution is applied to the semiconductor substrate to remove the metal contaminants. The cleaning solution comprises an organic solvent and a compound containing fluorine. The chemical constituents of the cleaning solution are effective in the removal of metal contaminants from the surface of the semiconductor substrate, yet are substantially unreactive with any metal interconnect material underlying a dielectric layer. As such, the early introduction of the cleaning step shortens the processing time and increases throughput.

Optical indicators include inert dyes that are released from the ruptured voids that stain the worn polishing pad. An operator of the polishing machine then sees a color change, e.g. through a sight tube that conveys the washing solution away from the polishing surface. Alternatively, a spectrophotometer, a light meter, a turbidity meter, or the like can be used to automatically monitor a sight tube that conveys the washing solution away from the polishing surface. A signal from the spectrophotometer is processed to derive therefrom an acknowledgement as to the end of the useful life of the fixed abrasive pad, such as when a dye that has been disbursed from ruptured voids flows through a sight tube being monitored by the specific meter.

Depending upon the content of the voids, the diagnostic or the detectable signal from the contents of the voids will be proportional to the amount of such contents released from the fixed abrasive pad. As the number of voids that are abraded by the polishing operation increases, the ability to detect a condition indicative of the end of the useful life of the pad increases. Thus, as seen in FIG. 3, deeper wear into fixed abrasive pad 10 breaches increasingly more voids 12 to release an increasingly amount of worn-pad indicator substance 16.

Specific embodiments of the present invention as drawn to fixed-abrasive polishing pads are set forth below. In one embodiment, a polishing pad comprises an elastomeric substance having a polishing surface and a structure beneath the polishing surface that contains a worn-pad indicator substance, for producing a detectable signal as abrading of the elastomeric substance releases the worn-pad indicator substance.

The polishing pad may have several variations. Signal detection can be accomplished by several selected means. For example a detectable signal may be a color, and the worn-pad indicator substance may be a dye. The detectable signal may be a sound, and the worn-pad indicator substance may be a gaseous fluid. The detectable signal may be a change in the pH of a first fluid on the polishing pad, and the worn-pad indicator substance may be a second fluid having a pH substantially different from that of the first fluid on the polishing pad. The detectable signal may be a change in electrical conductivity of a first fluid on the polishing pad, and the worn-pad indicator substance may be a second fluid causing a change in electrical conductivity when introduced to the first fluid on the polishing pad. The detectable signal may be a change in a metal contaminants concentration in a first fluid on the polishing pad, and the worn-pad indicator substance may be a second fluid causing a change of the metal contaminants concentration of the first fluid when introduced to the first fluid on the polishing pad. The detectable signal may be a change in a coefficient of friction between the elastomeric substance in contact with a polished surface, and the worn-pad indicator substance may be a lubricant causing a change the coefficient of friction between the elastomeric substance and the polished surface when introduced therebetween. The detectable signal may be a change in the temperature of the elastomeric substance, and the worn-pad indicator substance may be a material causing an exothermic reaction when exposed to the ambient outside the elastomeric substance.

Structural limitations include a structure for producing a detectable signal, for example, a void having a worn-pad indicator substance therein. There may also be a plurality of voids, and the plurality can be either configured in substantially a single geometric plane or it can be vertically staggered. Another structural limitation is that the abrasive material is incorporated within the elastomeric substance.

Another embodiment of the present invention is a polishing system wherein the pad is made of a composite substance having a polishing surface and a structure incorporated within the composite substance beneath the polishing surface. Contained in the structure is a worn-pad indicator substance for producing a detectable signal when abrading of the composite substance releases the worn-pad indicator substance therefrom. Part of the system is a semiconductor substrate having a surface to be polished by the polishing pad. The mechanical part of the system is a device for moving at least one of the polishing pad and the surface to be polished relative to and in contact with each other. All indicator and structural limitations set forth above are alternative embodiments of the present invention.

Another embodiment of the present invention is a method of detection of the point at which a polishing pad has ended the useful life thereof, referred to herein as worn-pad detection. The method of the present invention includes providing a polishing pad that has a composite substance having a polishing surface, and a structure incorporated within the composite substance beneath the polishing surface. Within the structure, a worn-pad indicator substance is contained. The indicator substance is for producing a detectable signal as abrading of the composite substance releases the worn-pad indicator substance. As part of the method of detection, a semiconductor substrate is provided that has a surface to be polished. Polishing is accomplished by moving at least one of the polishing pad and the unpolished surface to be polished by the polishing pad relative to and in contact with the other, so as to abrade the composite substance and release therefrom the worn-pad indicator substance. When the pad is sufficiently abraded, the voids are ruptured, the composite substance releases the worn-pad indicator substance, and a signal is detected.

Upon detection of a signal, the method can alternatively continue by stopping the movement of at least one of the polishing pad and the unpolished surface, removing the polishing pad, providing another polishing pad, resume polishing as before, and continuing until a detectible signal indicates wear of the pad. The method of the present invention can be repeated. All limitations of indicators and structures set forth above are contemplated for the method of detection set forth above.

3. Dyed Polishing Pads

Figure 5:
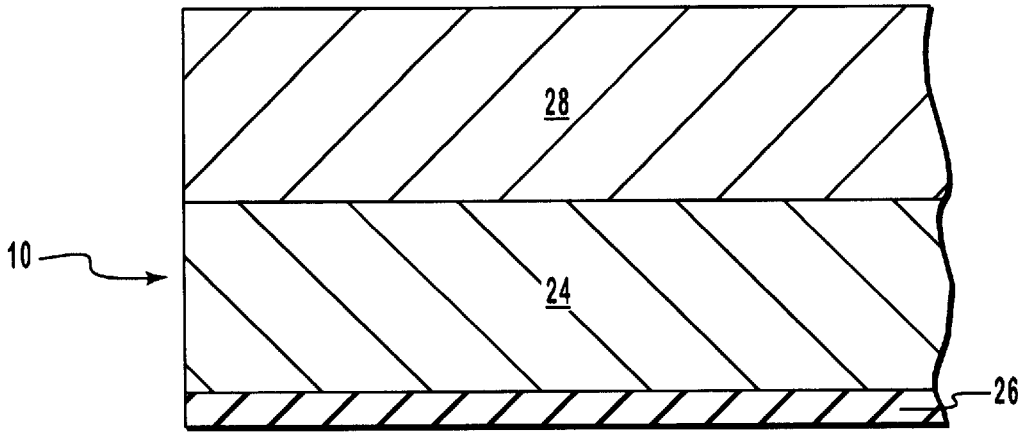
FIGS. 5 through 7 are cross-sectional views of a polishing pad having, respectively, two, three, and four regions of dye wear indicators.

FIG. 5 illustrates an embodiment of the present invention in which pad 10 has been dyed with two different dyes, a first dyed portion 24, and a second dyed portion 26. The undyed portion 28 of the pad is a pale color. In this embodiment, second dyed portion 26 is placed against the polishing platen and undyed portioned 28 is placed against the surface to be polished. During polishing, the operator is first warned upon observing the color of first dyed portion 24, and is finally warned upon observing the color of second dyed portion 26.

Figure 6:
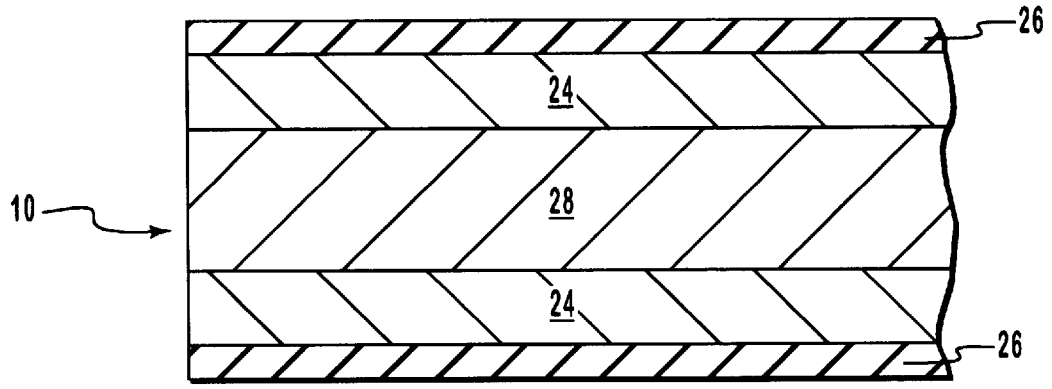

FIG. 6 is another embodiment of the present invention in which both sides of pad 10 are dyed, both with first dyed portion 24 and second dyed portion 26. Undyed portion 28 remains in the middle of pad 10. In this application, the operator, or an automated detection system, detects four distinct color changes as pad 10 wears through to the end of its useful life.

Figure 7:
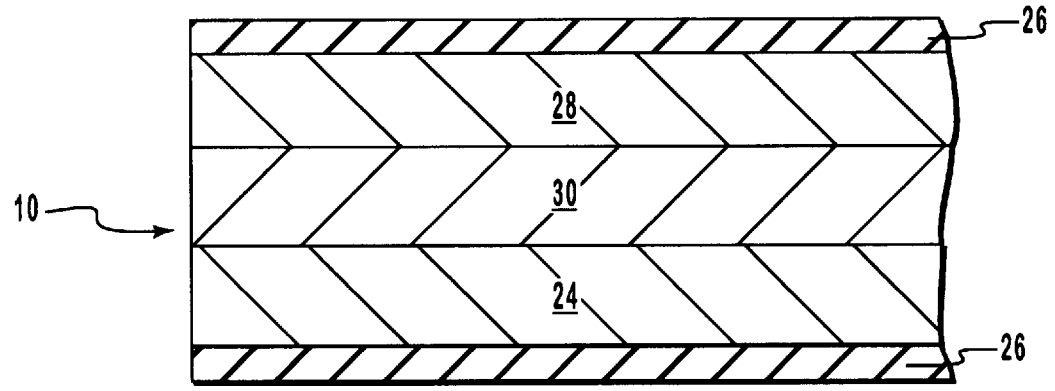

FIG. 7 illustrates another embodiment of the present invention in which pad 10 has been dyed with three distinct colors and also has undyed portion 28 as another distinct color. In this embodiment of the present invention the dyed portions refer to differently dyed portions and not to sequentially dyed portions. In forming the pad of this embodiment, a third dyed portion 30 permeates one side of pad 10 to a selected depth. Pad 10 is then dyed with a second dye to form first dyed portion 24. Pad 10 is then dyed with another dye on both sides to form second dyed portion 26. In this embodiment, third dyed portion 30 may comprise a dye that is lighter in color than first dyed portion 24 or second dyed portion 26, second dyed portion 26 being the darkest. Other dying schemes are within the ordinary skill of the artisan and can be achieved by routine experimentation.

Figure 8:
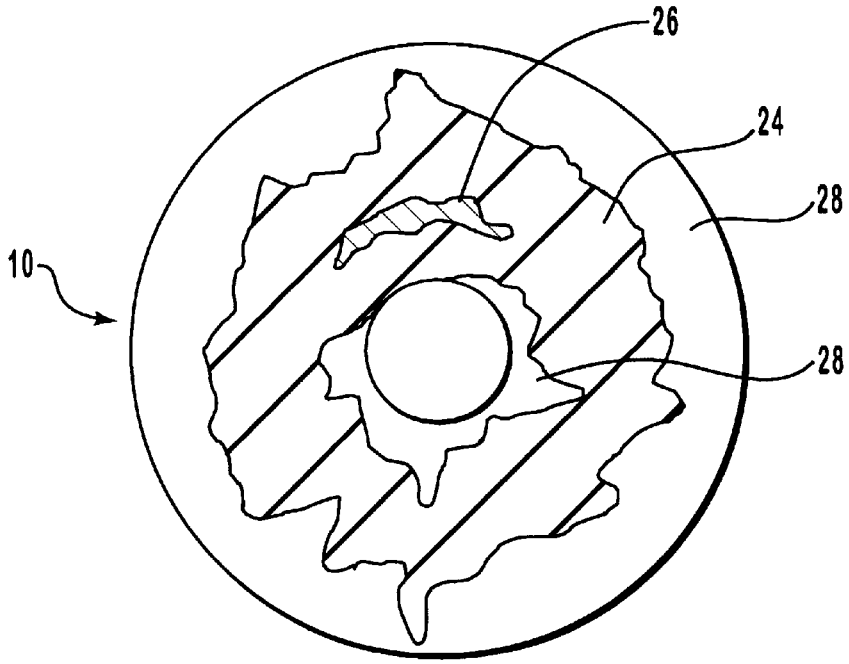
FIG. 8 is a plan view of a polishing pad in which wear is illustrated through a first and into a second wear indicator layer.

FIG. 8 is a plan view of pad 10 illustrated in FIG. 5 at a stage of a polishing operation. Undyed portion 28 is seen as being worn away in some areas in an irregular pattern, thus revealing first dyed portion 24, and the beginnings of second dyed portion 26 show through first dyed portion 24. This wear pattern illustrates to the operator how pad 10 is wearing during CMP. The operator has several options while viewing the wear of pad 10. As an analytical tool, the operator may notice a consistent wear pattern during employment of several polishing pads, which may be indicative of an irregular polishing platen, or a characteristic movement of articles to be polished upon pad 10.

Figure 9:
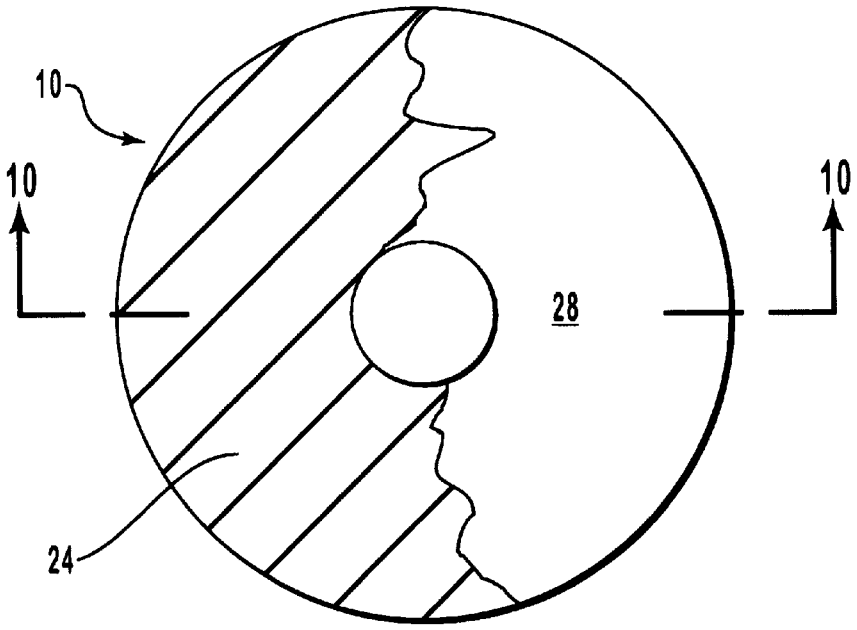
FIG. 9 is a plan view of a polishing pad in which wear is illustrated through a first wear indicator layer due to an irregularly sliced polishing pad.

FIG. 9 illustrates a plan view of pad 10 seen in FIG. 5 at a stage of a polishing operation. In FIG. 9 it is shown that a lopsided wear pattern has developed during use of pad 10. This irregular wear pattern may be caused by an irregularly sliced polishing pad taken from extruded stock. For example, FIG. 9 illustrates the exposure of first dyed portion 24 in a lopsided wear pattern in which undyed portion 28 remains over approximately half of the polishing surface of pad 10. By observing, the operator can gain a sense of what is happening during the polishing operation, and can adjust the polishing algorithm to maximize the useful life of pad 10.

Figure 10:
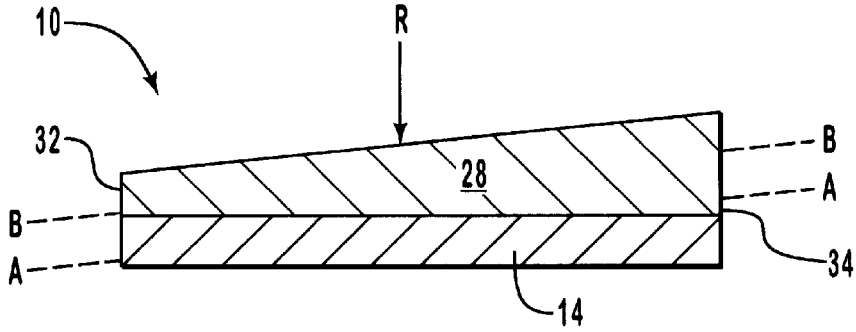
FIGS. 10 through 12 each are an exaggerated cross-sectional elevation view of an irregularly sliced polishing pad.

FIG. 10 is a cross-sectional slice taken along the line AA illustrated in FIG. 9. FIG. 10 illustrates undyed portion 28 and first dyed portion 24. In FIG. 10, pad 10 has a first edge 32 and a second edge 34. First edge 32 and second edge 34 are revealed by cross section. It can be seen that second edge 34 is thicker than first edge 32. FIG. 10 exaggerates an irregularly sliced pad or an irregularly wearing pad for illustrative purposes. Pad 10 may experience wear at substantially a right angle to the top surface in the direction illustrated by the arrow R. When pad 10 wears sufficiently, the intermediate wear pattern of pad 10 is illustrated in FIG. 9 along the line AA.

Figure 11:
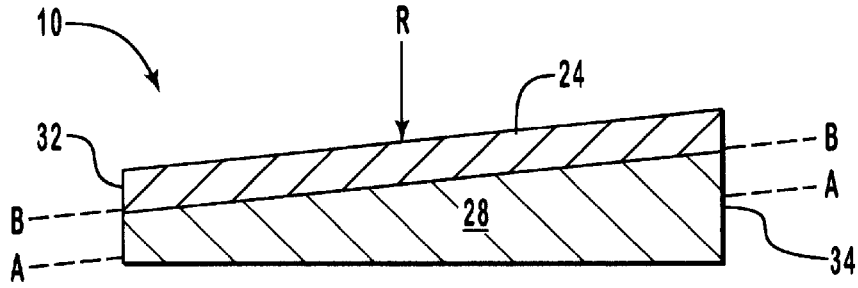
Figure 12:
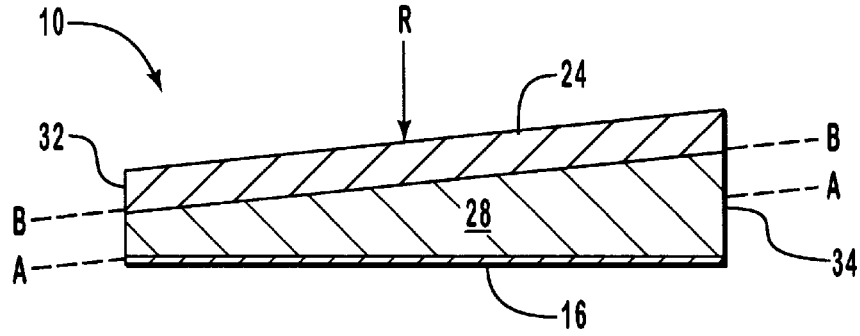

During polishing with any of pad 10 illustrated in FIGS. 10, 11, or 12, exposure of dyed regions will first occur in the plane containing the line BB. A dyeing scheme known by the operator to be according the embodiment depicted in FIG. 10, will reveal uneven wear early in the polishing or conditioning operation due to an irregularly fabricated pad. A dyeing scheme known by the operator to be according to the embodiment depicted in FIGS. 11 and 12 will not reveal uneven wear due to an irregularly fabricated pad. The article depicted in FIG. 12, if first dyed portion 24 were placed against the polishing platen, would alert the operator as to uneven wear only when a wear pattern would develop as depicted in FIG. 9.

The advantage of dyed wear layer indicators is that even when an irregularly fabricated polishing pad is put into service, the operator can monitor the wear and make adjustments to maximize useful pad life while remaining online.

In addition to real time monitoring, the dyeing scheme illustrated in FIG. 10 can be used to condition a pad until a known substantially planar surface has been exposed. In the inventive conditioning method, pad 10 is dyed with at least one color upon a surface that is to be affixed to the polishing platen. At least one dye is permeated through the pad in a substantially uniform application such that, when polishing pad 10 is irregular, only the irregular portion and some potential excess of the remainder of the pad remains undyed. In FIG. 10, this irregular portion, and some potential excess of the remainder of the pad, is undyed portion 28. All remaining portions of pad 10 are depicted as first dyed portion 24, however first dyed portion 24 can be a plurality of dyed portions. Each succeeding dyed "slice" of first dyed portion 24 would be shallower than the immediately previous dyed portion, and each succeeding "slice" would be darker so as to distinguish it from all previously dyed portions. Subsequent dyeing operations are normally required to be shallower and darker; non-opaque dyes can combine with previously dyed portions to make mixed colors.

As the operator begins to condition the pad for example by applying a diamond-bit buffer thereover, the irregular portion will be removed and the operator can continue conditioning until the at least one dye that has permeated to the greatest depth is fully exposed. The operator adjusts the conditioning to remove only undyed portion 28. Upon complete removal of undyed portion 28, the operator knows that a substantially planar surface is exposed.

With respect to pad conditioning, the inventive method includes steps for conditioning of a polishing pad. The polishing pad can be composed of an elastomeric substance. To condition the pad a first surface on the polishing pad is abraded to planarize it. Then at least one dye is applied to the first surface which is allowed to penetrate below the first surface of the polishing pad to a selected depth therein. Alternatively, at least another dye can be applied to the first surface and allowed to penetrate below the first surface of the polishing pad to another selected depth therein. The another selected depth can be is less than the first selected depth, and the at least one other dye is preferably visibly distinguishable from the first dye. At least a portion of the polishing pad can be undyed. Optionally, the abrading can be preceded by applying at least one dye to the first surface and allowing the at least one dye to penetrate below the first surface of the polishing pad to a selected depth therein.

A more complex pad contains a plurality of dyed levels. Initial pad conditioning, or conditioning between polishing jobs, is facilitated by the plurality of dyed "slices" in pad 10 in which the operator rips pad 10 down to the next dyed portion. The limitation on the total plurality of differently dyed "slices" of pad 10 depends upon pad thickness and the ability of the operator to dye pad 10 with a plurality of substantially planar pad "slices."

FIGS. 11 and 12 illustrate other possible coloring schemes that are within the contemplation of the present invention that indicate irregular wear to the operation. For example, in FIG. 11, wear would again be substantially at a right angle to the upper surface of pad 10 as indicated by arrow R. When wear proceeds through first dyed portion 24, the operator would not be informed that pad 10 was wearing nonuniformly, and wear would reach the base of first edge 32 before reaching the base of second edge 34.

FIG. 12 illustrates another embodiment for dyeing a pad that would be detected as having been irregularly fabricated. First dyed portion 24 would wear at an angle substantially perpendicular to arrow R such that undyed portion 28 would be virtually uniformly exposed. The base of first edge 24, however, would expose second dyed portion 16 before the base of second edge 34 would expose second dyed portion 26.

Second dyed portion 26 in accordance with the embodiment of FIG. 8 could be of a color that alerts the operator that polishing must stop immediately upon exposure of second dyed portion 26.

Dyed Fixed-Abrasive Polishing Pads

Figure 13:
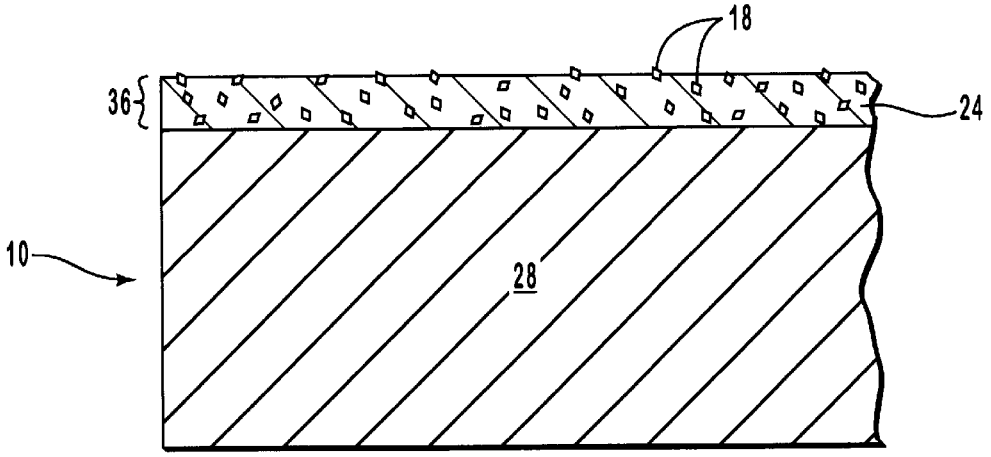
FIGS. 13 and 14 are cross-sectional views of a fixed-abrasive polishing pad having, respectively, one and two regions of dye wear indicators.

FIG. 13 illustrates pad 10 combined with a color indicating wear layer comprising first dyed portion 24. In pad 10 first fixed abrasive 18 is fixed in the uppermost level 36 of pad 10. First fixed abrasive 18 is imbedded only as deep as the bottom of first dyed portion 24. Thus, when all of first fixed abrasive 18 has worn away, first dyed portion 24 will have also worn away and the operator knows, or automated detection detects, that pad 10 is at the end of its service life.

Figure 14:
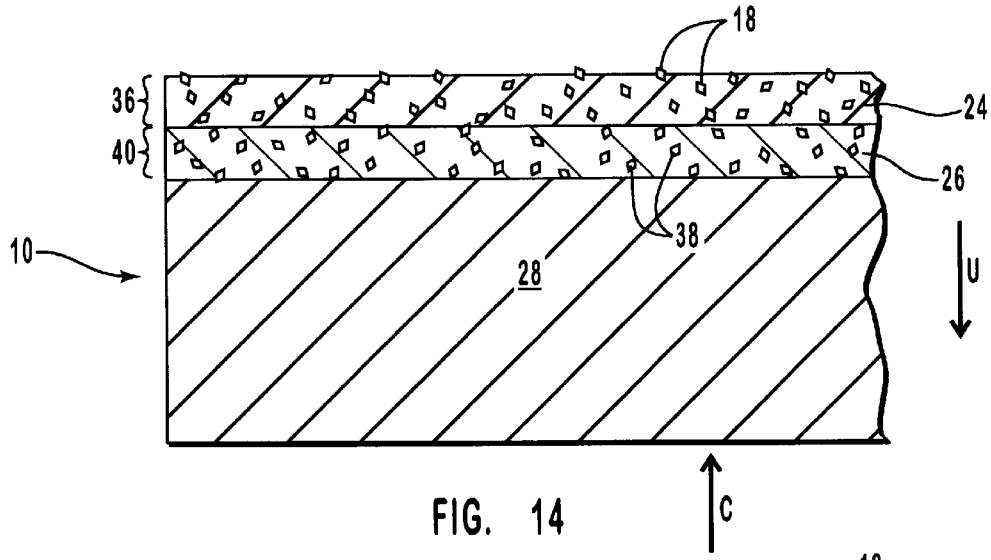

The present invention comprises also multiple wear indicator layers with fixed abrasive polishing pads. FIG. 14 illustrates a multiple wear-layer embodiment with two wear indicator layers. Pad 10 contains first dyed portion 24 with first fixed abrasive 18 within uppermost level 36, second dyed portion 26 with a second fixed abrasive 38 in a first sublevel 40. In FIG. 14, a wear pattern merely analogous to that depicted in FIG. 8 will eventually arise during operation, and the operator has the advantage of directing the article to be polished to portions of pad 10 that have not sufficiently worn through the fixed abrasive layers comprising first dyed portion 24 or second dyed portion 26, etc.

Other multiple-wear embodiments of the present invention comprise more wear layers than uppermost level 36 and first sublevel 40. For example, several wear layers can be manufactured in pad 10 wherein abrasives are fixed within the wear layers.

Formation of a polishing pad that contains abrasives fixed throughout the entire pad structure can also be accomplished, and multiple dye layers can be placed within the polishing pad to indicate to the operator the wear of the polishing pad while polishing an article to be polished. The limit of wear layers that can be accomplished in a polishing pad is within the level of skill of the ordinary artisan and can be accomplished by reading the disclosure of the present invention and by practicing the invention as taught herein.

In an alternative embodiment, pad 10 of FIG. 14 is conditioned by affixing pad 10 with uppermost level 36 against the polishing platen. In other words, pad 10 is affixed against the polishing platen upside-down to its orientation depicted in FIG. 14. A plurality of levels, including first sublevel 40 and other sublevels (not shown) extend upwardly from the polishing platen in the direction U as depicted in FIG. 14. Conditioning is carried out according to the method set forth above. Conditioning rips pad 10 in the direction C until pad 10 has been ripped down to the "nth" sublevel, which in the case illustrated in FIG. 14 is down to first sublevel 40. In this alternative embodiment, the operator has ripped pad 10 to remove any irregularities, and polishing can begin with a substantially planar sublevel. Conditioning in this alternative embodiment is carried out either before any polishing occurs, or between polishing jobs or both.

Figure 15:
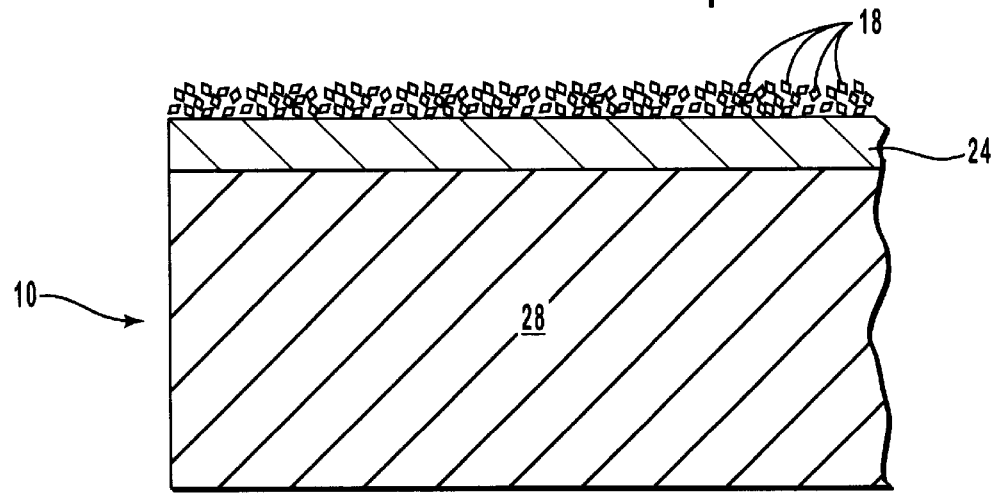
FIG. 15 is a cross-sectional view of a fixed-abrasive polishing pad with abrasives superficially affixed to the pad and having immediately beneath the abrasives a first dyed portion that indicates upon exposure of same that the abrasives have worn off.

FIG. 15 illustrates another embodiment of the present invention in which pad 10 has first fixed abrasive 18 superficially affixed to pad 10 and first dyed portion 24 lies directly beneath first fixed abrasive 18. Use of pad 10 in this embodiment is stopped upon exposure of first dyed portion 24, where first exposure of first dyed portion 24 indicates that first fixed abrasive 18 is worn away. Alternatively, first fixed abrasive 18 can have a visibly distinguishable color that is detectable by its presence or absence during a polishing operation.

5. Polishing Apparatuses

In employing a conventional CMP apparatus, articles to be polished are mounted on polishing blocks which are placed on the CMP machine. A polishing pad is adapted to engage the articles carried by the polishing blocks. A cleaning agent can be dripped onto the pad continuously during the polishing operation while pressure is applied to the article to be polished. A typical CMP apparatus comprises a rotatable polishing platen, and a polishing pad mounted on the platen. A motor for the platen can be controlled by a microprocessor to spin at about 10 RPM to about 80 RPM. The article to be polished can alternatively be mounted on the bottom of a rotatable polishing head so that a major surface of the substrate to be polished is positionable to contact the underlying polishing pad.

The article to be polished and polishing head can be attached to a vertical spindle which is rotatably mounted in a lateral robotic arm which rotates the polishing head at about 10 to about 80 RPM in the same direction as the platen and radially positions the polishing head. The robotic arm can also vertically position the polishing head to bring the article to be polished into contact with the polishing head and maintain an appropriate polishing contact pressure.

A tube opposite the polishing head and above the polishing pad can dispense and evenly saturate the pad with an appropriate cleaning agent, typically a slurry. If the pad contains fixed abrasive, the cleaning agent can be a simple rinse or a chemical that enhances the polishing.

The inventive polishing pads, and systems and methods incorporating the same, are contemplated to place abrasive particles within the pad itself and/or within a slurry used in the inventive polishing methods. Thus, an inventive elastomeric pad with or without abrasives is proposed.

In the present invention a fixed abrasive pad can be used with inert or non-inert indicator substances that are employed on a parallel test substrate. The parallel test substrate has a surface thereon that is to be planarized identically to a production substrate. The parallel test substrate, however, is only employed to indirectly monitor the polishing of production substrates by the pad.

For multiple-article polishing and the resulting higher production rate of planarized substrates, there will be employed a plurality of pads for a plurality of production substrates mounted on rotatable platens, and a test substrate likewise being equivalently planarized on a pad that contains the indicator layer or layers. The substrate and the production substrates are all subject to the same abrasives, RPMs, pressures, temperatures, and chemical or physical washings or rinsings. The worn-pad indicator substance, however, may be contained in voids found only within the fixed abrasive pad used to planarize the test substrate As such, the worn-pad indicator substance can be destructive to the test substrate, in a destructive testing process without significantly effecting yield of production substrates.

Other polishing apparatuses include oscillating polishers, planetary polishers, belt or tape polishing pads, and devices to move the articles to be polished in rotational translation, oscillatory, and planetary motions, and combinations thereof.

6. Worn-pad Detection Methods

The present invention allows for maximum use of pads without damaging one or several articles to be polished after the polishing pad is worn out but before it was detected. By maximizing the useful life of the polishing pad, fewer shutdowns are required because previously the operator would replace the pad after an experimentally determined number of cycles, which may be some number fewer than the maximum number of cycles for the useful life of the pad. Over time, throughput and yield are increased, and downtime is minimized.

The present invention may be embodied in other specific forms without departing from its spirit or essential characteristics. The described embodiments are to be considered in all respects only as illustrated and not restrictive. The scope of the invention is, therefore, indicated by the appended claims and their combination in whole or in part rather than by the foregoing description. All changes which come within the meaning and range of equivalency of the claims are to be embraced within their scope.

What is claimed and desired to be secured by United States Letters Patent is:

1. A method of forming a polishing pad, comprising:

forming an elastomeric material into a polishing pad having a planar surface; and dyeing said polishing pad with at least one dye to color the elastomeric material with a color that extends from the planar surface to a pad depth.

2. A method of forming a polishing pad according to claim 1, wherein said elastomeric material is selected from the group consisting of polyurethane, polymethylmethacrylate, polytetratluoroethylene, natural resins, and other synthetic resins.

3. A method of forming a polishing pad according to claim 1, wherein said elastomeric material further comprises a plurality of abrasive particles.

4. A method of forming a polishing pad to claim 1, wherein dyeing said polishing pad with at least one dye to color the elastomeric material with a color that extends from the planar surface to a pad depth comprises forming at least one planar interface between a colored portion of said polishing pad and a differently colored portion of said polishing pad.

5. A method of forming a polishing pad according to claim 1, wherein dyeing said polishing pad with at least one dye to color the elastomeric material with a color that extends from the planar surface to a pad depth comprises:

permitting said at least one dye to permeate into the polishing pad from the planar surface with a first dye.

6. A method of forming a polishing pad according to claim 5, wherein permitting said at least one dye to permeate into the polishing pad from the planar surface with a first dye comprises:

permitting a plurality of dyes to penneate into the polishing pad from the planar surface, each said dye permeating into the polishing pad to a depth different than that of the other dyes, whereby visually different colors exist at different depths within the polishing pad.

7. A method of forming a polishing pad according to claim 6, wherein said elastomeric material is selected from the group consisting of polyurethane, polymethylmethacrylate, polytetrafluoroethylene, natural resins, and other synthetic resins.

8. A method of forming a polishing pad according to claim 1, wherein dyeing said polishing pad with at least one dye to color the elastomeric material with a color that extends from the planar surface to a pad depth comprises:

permitting a second dye to permeate into the polishing pad from the planar surface, the first and the second dyes each permeating into the polishing pad to a depth different than that of the other, whereby visually different colors exist at two different depths within the polishing pad.

9. A method of forming a polishing pad according to claim 6, wherein at a portion of the polishing pad is not dyed by said plurality of dyes.

10. A method of forming a polishing pad according to claim 8, wherein at a portion of the polishing pad is not dyed by the first and second dyes.

11. A method of forming a polishing pad according to claim 8, wherein said elastomeric material is selected from the group consisting of polyurethane, polymethylmethacrylate, polytetrafluoroethylene, natural resins, and other synthetic resins.

12. A method of forming a polishing pad according to claim 5, wherein dyeing said polishing pad with at least one dye to color the elastomeric material with a color that extends from the planar surface to a pad depth comprises forming at least one planar interface between a colored portion of said polishing pad and a differently colored portion of said polishing pad.

13. A method of forming a polishing pad according to claim 8, wherein dyeing said polishing pad with at least one dye to color the elastomeric material with a color that extends from the planar surface to a pad depth comprises forming at least one planar interface between a colored portion of said polishing pad and a differently colored portion of said polishing pad.

14. A method of forming a polishing pad comprising:

forming a polishing pad having opposing planar surfaces and being composed of a material selected from the group consisting of polyurethane, polymethylmethacrylate, polytetrafluoroethylene, natural resins, and other synthetic resins;

dyeing said polishing pad with a first dye that is applied to both of the opposing planar surfaces to color the material with a first color that extends from each said opposing surface, respectively, to a first depth therefrom; and dyeing said polishing pad with a second dye that is applied to both of the opposing planar surfaces to color the material with a second color that extends from said first depth respective to said opposing planar surfaces to a second depth respective to said opposing planar surfaces, whereby the polishing pad at said opposing planar surfaces is visually different in color than the color of the polishing pad at the second depth respectively from the opposing planar surfaces.

15. A method of forming a polishing pad according to claim 14, wherein dyeing said polishing pad with a first dye that is applied to both of the opposing planar surfaces to color the material with a first color that extends from each said opposing surface, respectively, to a first depth therefrom comprises forming at least one planar interface between a colored portion of said polishing pad and a differently colored portion of said polishing pad.

16. A method of forming a polishing pad according to claim 14, wherein a portion of said polishing pad is undyed by a dye.

17. A method of forming a polishing pad according to claim 14, wherein said material further comprises a plurality of abrasive particles.

18. A method of forming a polishing pad comprising:

forming a polishing pad having opposing first and second planar surfaces and being composed of a material selected from the group consisting of polyurethane, polymethylmethacrylate, polytetrafluoroethylene, natural resins, and other synthetic resins;

dyeing said polishing pad with a first dye that is applied to the first opposing planar surface to color the material with a first color that extends from the first opposing planar surface to a first depth therefrom;

dyeing said polishing pad with a second dye that is applied to the first opposing planar surface to color the material with a second color that extends from said first depth to a second depth from the first opposing planar surface, wherein the first and second colors are visually distinguishable; and dyeing said polishing pad with a third dye that is applied to both of the first and second opposing planar surfaces, said third dye permeating into the polishing pad to color the material with a third color that extends:

from said second depth to a third depth from the first opposing planar surfaces; and from the second opposing planar surface to a fourth depth, wherein the polishing pad is colored by the first, second, and third dyes with at least three visually distinguishable colors.

19. A method of forming a polishing pad according to claim 18, wherein dyeing said polishing pad with a first dye that is applied to both of the opposing planar surfaces to color the material with a first color that extends from each said opposing surface, respectively, to a first depth therefrom comprises forming at least one planar interface between a colored portion of said polishing pad and a differently colored portion of said polishing pad.

20. A method of forming a polishing pad according to claim 18, wherein a portion of said polishing pad is undyed by a dye.

21. A method of forming a polishing pad according to claim 18, wherein said material further comprises a plurality of abrasive particles.

22. A method of conditioning a polishing pad comprising:

abrading a first surface on a polishing pad to planarize said first surface said polishing pad being composed of an elastomeric substance, and applying at least one dye to said first surface and allowing said at least one dye to penetrate below said first surface of said polishing pad to a depth therefrom so as to color the elastomeric substance with a visually recognizable color that extends from the planarized first surface to said depth.

23. A method of conditioning a polishing pad according to claim 22, wherein applying at least one dye to said first surface and allowing said at least one dye to penetrate below said first surface of said polishing pad to a depth therein comprises:

applying a first dye to the first surface and allowing the first dye to penetrate below the first surface of said polishing pad to a first depth therein; and applying at least one other dye to the first surface and allowing the at least one other dye to penetrate below the first surface of said polishing pad to another depth therefrom, wherein;

said another depth is less than said first depth; and the application of said at least one other dye renders the portion of said polishing pad subjected thereto to be visually different in color that the portion of the polishing pad that was subjected to the first dye is visibly distinguishable from said first dye.

24. A method of conditioning a polishing pad according to claim 22, wherein at least a portion of said polishing pad is undyed.

25. A method of conditioning a polishing pad according to claim 22, wherein abrading a first surface on a polishing pad to planarize said first surface is preceded by applying at least one dye to said first surface and allowing said at least one dye to penetrate below said first surface of said polishing pad to a depth therein.

26. A method of optimizing the useful wear life of a polishing pad comprising:

providing a polishing pad with a plurality of distinguishable colors in sequentially and planar levels through said polishing pad, said polishing pad having a wear surface and being composed of an elastomeric substance; and polishing an object with said wear surface to expose at least two different surfaces on the polishing pad each having a different color of said plurality of distinguishable colors.

27. A method of optimizing the useful wear life of a polishing pad according to claim 26, further comprising terminating said polishing of said object when a surface is exposed on the polishing pad that has a particular color of said plurality of distinguishable colors.

28. A method of optimizing the useful wear life of a polishing pad according to claim 26, further comprising, prior to polishing said object:

abrading the wear surface to planarize the wear surface.

29. A method of optimizing the useful wear life of a polishing pad according to claim 26, wherein polishing an object with said wear surface comprises a chemical mechanical polishing operation.

* * * * *